United States Patent [19]

Lee et al.

[11] 4,222,191

[45] Sep. 16, 1980

[54] CONVERSION PLUG

[76] Inventors: Thomas M. Lee, 17 Prospect St., Millbury; Charles Kupfer, South Oxford Rd., West Millbury, both of Mass. 01527

[21] Appl. No.: 938,024

[22] Filed: Aug. 30, 1978

[51] Int. Cl.[3] ..... F41C 21/12

[52] U.S. Cl. ..... 42/77; 42/51

[58] Field of Search ..... 42/77, 51

[56] References Cited

U.S. PATENT DOCUMENTS

| | | | |
|---|---|---|---|
| 158,221 | 12/1874 | Smith | 42/51 |
| 173,476 | 2/1876 | Ladd | 42/77 |
| 237,357 | 2/1881 | Zundorff | 42/77 |
| 351,333 | 10/1886 | Morris | 42/77 |
| 2,342,684 | 2/1944 | Nelson | 89/29 |
| 2,898,694 | 8/1959 | Senutovitch | 42/77 |
| 3,196,569 | 7/1965 | Thomason | 42/77 |
| 3,645,027 | 2/1972 | Palmer | 42/77 |
| 3,780,464 | 12/1973 | Anderson | 42/51 |
| 3,805,434 | 4/1974 | Sudano | 42/77 |

*Primary Examiner*—Charles T. Jordan

*Attorney, Agent, or Firm*—Norman S. Blodgett; Gerry A. Blodgett

[57] ABSTRACT

Conversion plug having the general shape of a shotgun shell, having a large counterbore formed in the end adjacent the hammer and having a small threaded counterbore to receive a nipple adapted to receive a percussion firing element.

5 Claims, 6 Drawing Figures

CONVERSION PLUG

BACKGROUND OF THE INVENTION

In recent years there has been an increased interest in the use of black powder in the firing of various types of guns. There are various reasons for this, one of them being a natural interest in primitive weapons and the use of antique methods of firing. Another reason is that in most states there is a special black powder hunting time period, which usually proceeds the regular hunting period. The philosophy of these laws is that those persons hunting with less than sophisticated weaponry (as in the case of hunting with the bow or with muzzle-loading rifles) should be given a special period for hunting, since they are much less likely to reduce the supply of the hunting game. Unfortunately, in the past this has required that a hunter have a special black powder gun in addition to his conventional hunting equipment. These and other difficulties experienced with the prior art devices have been obviated in a novel manner by the present invention.

It is, therefore, an outstanding object of the invention to provide a conversion unit for permitting a shotgun to be used as a muzzle-loading gun.

Another object of this invention is the provision of a conversion unit for bringing about positive firing of black powder when used in a shotgun or the like.

A further object of the present invention is the provision of a conversion unit for converting a gun which normally uses a cartridge or a shell into a gun capable of use as a muzzle-loader with black powder.

It is another object of the instant invention to provide a conversion unit which may use either a percussion cap or a shotgun shell primer.

A still further object of the invention is the provision of a conversion unit for use in a shotgun which is inexpensive to manufacture, which is simple in construction and which is capable of a long life of useful service with a minimum of maintenance.

It is a further object of the invention that the provision of a conversion unit for permitting positive firing of black powder in a muzzle-loading gun.

With these and other objects in view, as will be apparent to those skilled in the art, the invention resides in the combination of parts set forth in the specification and covered by the claims appended hereto.

SUMMARY OF THE INVENTION

In general, the invention consists of a conversion plug for use with a gun having a chamber leading to a bore and having a hammer. An elongated body is provided having an external cylindrical surface adapted to fit smoothly into the chamber and a relatively small passage extending axially through the body with a large counterbore formed in the end of the body adjacent the hammer. The threaded small counter bore enters the passage from the bottom of the large counter bore and a nipple having one end portion formed for threaded engagement with the small counterbore is provided. The nipple has a passage extending axially through it and is adapted to receive a percussion firing element and to hold it in position to be struck by the hammer.

More specifically, the external cylindrical surface of the elongated body is provided with a groove intermediate of its ends in which a resilient O-ring is located. A small flange extends laterally from the cylindrical surface at the end adjacent the hammer and a portion of the cylindrical surface between the groove and the other end has a slightly smaller diameter than the portion of the cylindrical surface between the groove and the flange.

DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
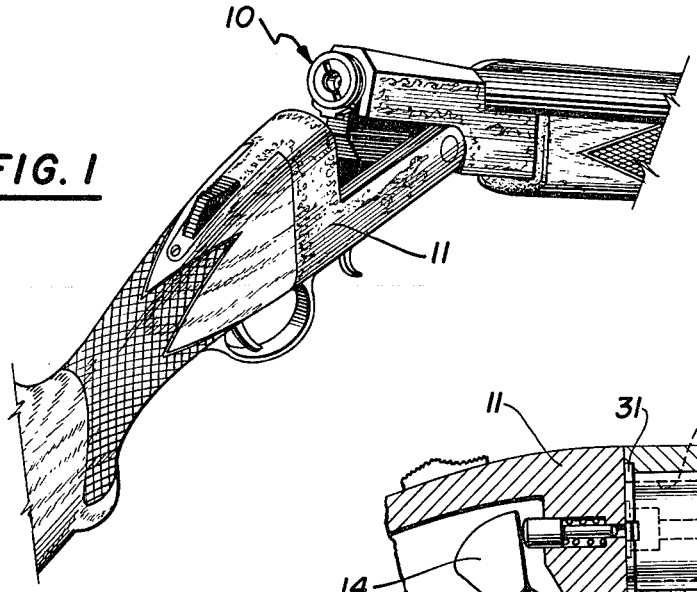
FIG. 1 is a perspective view of a conversion unit incorporating the principles of the present invention in use with a shotgun.

Referring first to FIG. 1, wherein is best shown the general features of the invention, the conversion unit, indicated generally by the reference numeral 10, is shown in use with a shotgun 11 which is broken open to show the conversion unit.

Figure 3:
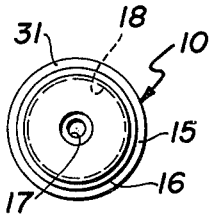
FIG. 3 is a right-hand end view of the conversion unit.
Figure 2:
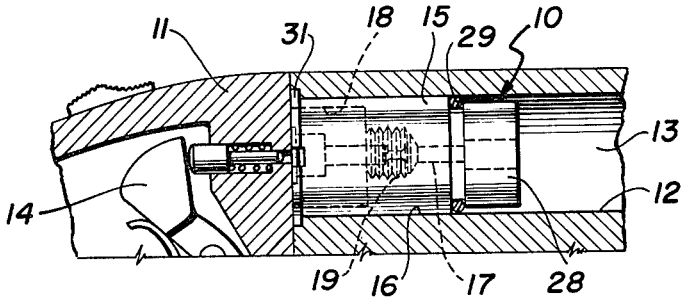
FIG. 2 is a side elevational view of the conversion unit.

Referring to FIGS. 2 and 3, it can be seen that the gun 11 is provided with a chamber 12 leading to a bore 13 and is provided with a hammer 14. The unit consists of an elongated body 15 having an external cylindrical surface 16 adapted to fit snugly in the chamber 12 of the gun. A relatively small passage 17 extends axially through the body 15 and a large counterbore 18 is formed in the end of the body 15 adjacent the hammer 14. A threaded small counterbore 19 enters the passage 17 from the bottom of the large counterbore 18.

Figure 4:
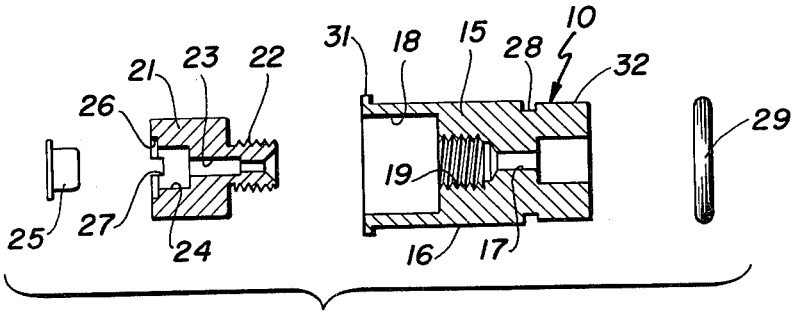
FIG. 4 is an exploded sectional view of the conversion unit.

Referring to FIG. 4, it can be seen that a nipple 21 is provided having one end portion 22 formed to be threaded into the small counterbore 19 of the body 15. The nipple has a passage 23 which extends axially through it and is adapted to receive a percussion firing element, such as a shotgun shell primer 25, to hold it in position to be struck by the hammer 14.

Figure 5:
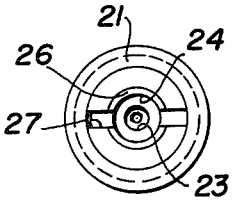
FIG. 5 is a separated left-hand end view of the unit.
Figure 6:
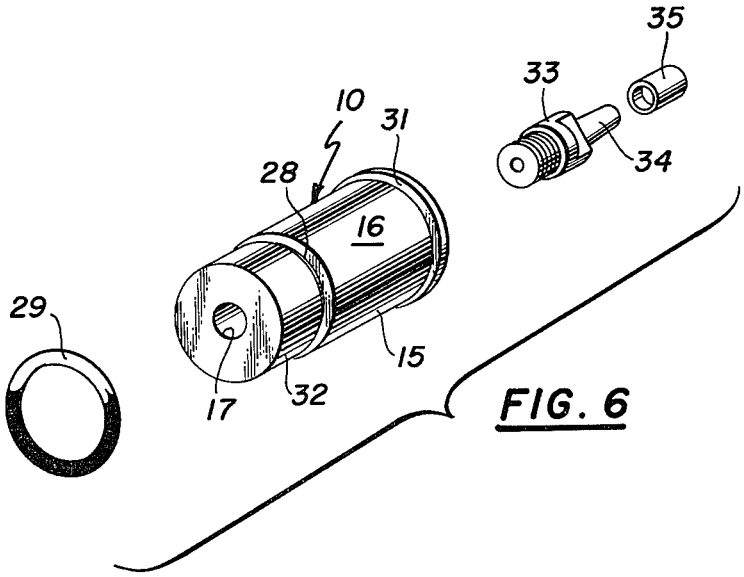
FIG. 6 is an exploded view of the conversion unit showing a modified form of the nipple and percussion element.

As is evident in FIGS. 4, 5 and 6, the nipple 21 has a main counterbore 24 which is concentric with the passage 23 and faces away from the threaded end portion 22 to receive the shotgun primer 25 and it has a shallow counterbore 26 to receive the flange of the primer. A screwdriver slot 27 extends across the end face of the nipple 21 that is occupied by the counterbores 25 and 26. The external cylindrical surface 16 of the elongated body 15 is provided with a groove 28 intermediate of its ends and a resilient O-ring 29 is located in the groove. A small flange 31 extends laterally from the cylindrical surface 16 at the end adjacent the hammer 14. The portion 32 of the cylindrical surface 16 that lies between the groove 28 and the other end, has a slightly smaller diameter than the portion of the cylindrical surface that lies between the groove 28 and the flange 31.

As is evident in FIG. 6, the body 15 is capable of receiving a modified form of the nipple 21. This form has a conical outer surface 34 at the end opposite the threaded end and is adapted to receive a percussion cap 35.

The operation and advantages of the invention will now be readily understood in view of the above description. The gun 11 is broken open to expose the chamber 12 and the conversion unit 10 is inserted. The O-ring 29 brings about a snug fit of the unit in the chamber with the flange 31 fitting in the slight recess that is normally provided in the chamber to receive the corresponding flange of a shotgun shell or other type of cartridge. If the gun is to be used with a shotgun shell primer 25, then the nipple 21 is used. The threaded portion 22 is inserted in the threaded counterbore 19 of the body 15 and is tightened by use of a screwdriver operating in the slot 27. The black powder is then inserted in the bore 31 and rammed home with suitable wadding and shot. The primer 25 is then inserted in the counterbore 24 of the nipple 21 with its body fitting snugly in the counterbore and its flange fitting snugly in the slight recess or counterbore 26. The gun is then closed and set. Pulling the trigger, of course, will cause the hammer 14 to strike the primer 25 which causes a blast of flame to pass through the passage 23 of the nipple 21 and through the passage 17 of the body 15. This gives positive firing of the black powder.

If a percussion cap 35 is to be used, as indicated in FIG. 6, instead of the nipple 21 being inserted in the body 15, the nipple 33 is used. The same threaded portion is provided to enter the threaded counterbore 19, but the nipple 33 is provided with wrench-engaging surfaces for tightening. It is normal practice first to lead the black powder, wadding, and shot in the bore 13 before placing the percussion cap 35 in place and actuating the firing mechanism of the gun.

It can be seen, then, that by use of the present invention it is possible to use a conventional shotgun for the muzzle-loading of black powder and all the advantages attendant thereon. The gun may, of course, be used at other times with conventional shells or cartridges. The chief advantage of the present invention is that it is possible to fire the black powder with a hot, positive blast of flame that assures ignition of the powder. The use of the large counterbore 18 assures that room is available for tightening the nipple 21 or 33 in place and also assures that there is room to swing the hammer 14. It is evident that the present invention can be used with various size of shotguns, preferably of the single-barrel type. It permits the hunter to convert a conventional shotgun into a muzzle-loading gun in an economical way for black powder shooting and hunting. The apparatus is relatively easy to install without machining of the shotgun and permits loading in the conventional way through the muzzle. It is capable of being used in shooting either balls, bullets, or shot and it is easy to clean the gun after use. The converter is easily removed by opening the shotgun, inserting a wooden dowel down the barrel, and driving it out with a light blow.

It is obvious that minor changes may be made in the form and construction of the invention without departing from the material spirit thereof. It is not, of course, desired to confine the invention to the exact form herein shown and described, but it is desired to include all such as properly come within the scope claimed.

The invention having been thus described, what is claimed as new and desired to secure by Letters Patent is:

1. Conversion unit for use with a gun having a chamber leading to a bore and having a hammer, comprising:

(a) an elongated body having an external cylindrical surface adapted to fit smoothly into the chamber, (b) a relatively-small passage extending axially through the body, (c) a large counterbore formed in the end of the body adjacent the hammer, (d) a threaded small counterbore entering the passage from the bottom of the large counterbore, and (e) a nipple having a threaded end portion for threaded engagement with the small counterbore, the nipple having a passage entending axially through it, a main counterbore concentric with the passage and facing away from the threaded end portion to receive the main body portion of a percussion firing element having a main body portion at one end and a flange at the other end, said nipple having a shallow counterbore concentric with and of larger diameter than the main counterbore for receiving the flange portion of said percussion firing element, said main and shallow counterbores being effective to hold said percussion firing element in position to be struck by the hammer.

2. Conversion unit as recited in claim 1, wherein a screwdrive slot extends across the end face of the nipple occupied by the shallow counterbore.

3. Conversion unit as recited in claim 1, wherein the external cylindrical surface of the elongated body is provided with a groove intermediate of its end and wherein a resilient O-ring is located in the groove.

4. Conversion unit as recited in claim 3, wherein a small flange extends laterally from the cylindrical surface at the end adjacent the hammer.

5. Conversion unit as recited in claim 4, wherein a portion of the cylindrical surface between the groove and the other end has a slightly smaller diameter than the portion of the cylindrical surface between the groove and the flange.

* * * * *